United States Patent [19]

Sansome et al.

[11] Patent Number: 4,537,577

[45] Date of Patent: Aug. 27, 1985

[54] TOY VEHICLE AND TRACK ASSEMBLY

[76] Inventors: Terry Sansome, 13176 Jasper Pl., Windsor, Ontario, Canada, N8N3K4; Thomas L. Simmel, 44 Booras La., Milford, Conn. 06460

[21] Appl. No.: 574,569

[22] Filed: Jan. 27, 1984

[51] Int. Cl.[3] ..... A63H 18/14

[52] U.S. Cl. ..... 446/445; 104/120; 104/248

[58] Field of Search ..... 446/444, 445, 446, 447, 446/454, 455, 456, 467; 273/86 B; 104/53, 55, 60, 121, 120, 118, 248, 246, DIG. 1

[56] References Cited

U.S. PATENT DOCUMENTS

| | | | |
|---|---|---|---|
| 1,606,691 | 11/1926 | Boyer | 446/446 X |
| 2,836,129 | 5/1958 | Jaeger | 104/248 |
| 3,209,491 | 10/1965 | Roeper | 446/444 X |
| 3,648,407 | 3/1972 | Pressman | 104/120 |
| 3,696,557 | 10/1972 | Ruppel | 446/444 |

FOREIGN PATENT DOCUMENTS

| | | |
|---|---|---|
| 401367 | 12/1932 | United Kingdom . |
| 619871 | 4/1946 | United Kingdom . |
| 604342 | 12/1946 | United Kingdom . |
| 1093295 | 11/1967 | United Kingdom . |
| 1224788 | 3/1971 | United Kingdom . |
| 2129318 | 5/1984 | United Kingdom . |

*Primary Examiner*—Mickey Yu

[57] ABSTRACT

A toy vehicle and track assembly includes a vehicle and a track along which the vehicle travels. The vehicle is formed with a plurality of wheels and a motor adapted to drive the wheels upon actuation. The track is formed with a guide extending along the length of the track. First and second clips are mounted for pivotal movement on the underside of the vehicle. The clips are adapted to engage the guide and to cooperate to move the vehicle towards the track such that at least one of the wheels is always in driving contact with the track.

19 Claims, 11 Drawing Figures

TOY VEHICLE AND TRACK ASSEMBLY

The invention relates to a toy vehicle and track assembly in which at least one of the driving wheels of the vehicle is always maintained in driving contact with the track.

Toy vehicle and track assemblies in which a toy vehicle moves along a continuous and often endless track are well known. Several different types of vehicle and track assemblies are currently available, with the object of each being that the vehicle remains on and moves along the track. In one type of toy vehicle and track assembly the track is formed with a centrally located groove extending along its length and the vehicle is formed with a pin which travels in the groove, thereby directing the car along the track. In another type, the side walls of the track extend above the wheels of the vehicle to prevent its departure therefrom. In a third type, magnets are placed in the vehicle to provide a magnetic attraction to the track so that the vehicle remains thereon.

All of these assemblies work well at low vehicle speeds and where the track remains somewhat level and the vehicle travels along the top thereof. These vehicle and track assemblies are not as effective in maintaining the car on the track in situations where the track is upside down and the vehicle is travelling below the track, when the track forms a circle or loop, or when the track and vehicle attempt a straight vertical climb. In these situations the force of gravity usually overcomes the vehicle's attraction to the track causing the vehicle to fall off the track. This disrupts play and limits the possible track configurations of these toy vehicle and track assemblies.

One object of the present invention is to provide a toy vehicle and track assembly in which at least one of the driving wheels of the vehicle is always maintained in driving contact with the track.

Another object of the present invention is to provide a toy vehicle and track assembly in which the vehicle remains in driving contact with the track even in situations where the track is upside down and the vehicle is travelling below it.

Still another object of the present invention is to provide a toy vehicle and track assembly in which the toy vehicle is maintained in driving contact with the track even when the track forms a circle or loop.

A further object of the present invention is to provide a toy vehicle and track assembly in which the vehicle remains in driving contact with the track even when the track and vehicle attempt a straight vertical climb.

A still further object of the present invention is to provide a toy vehicle and track assembly in which the possible track configurations are much greater than those possible with toy vehicle and track assemblies of the prior art.

In accordance with the present invention a toy vehicle and track assembly includes a vehicle and a track along which the vehicle travels. The vehicle is formed with a plurality of wheels and a motor adapted to drive the wheels upon actuation. The track is formed with a guide extending along the length of the track. First and second clips are mounted for pivotal movement on the underside of the vehicle. The clips are adapted to engage the guide and cooperate to move the vehicle towards the track such that at least one of the wheels is always in driving contact with the track.

Other and further objects will appear from the following description.

In the accompanying drawings to which reference is made in the instant specification and in which like reference characters refer to like parts in the various views.

Figure 1:
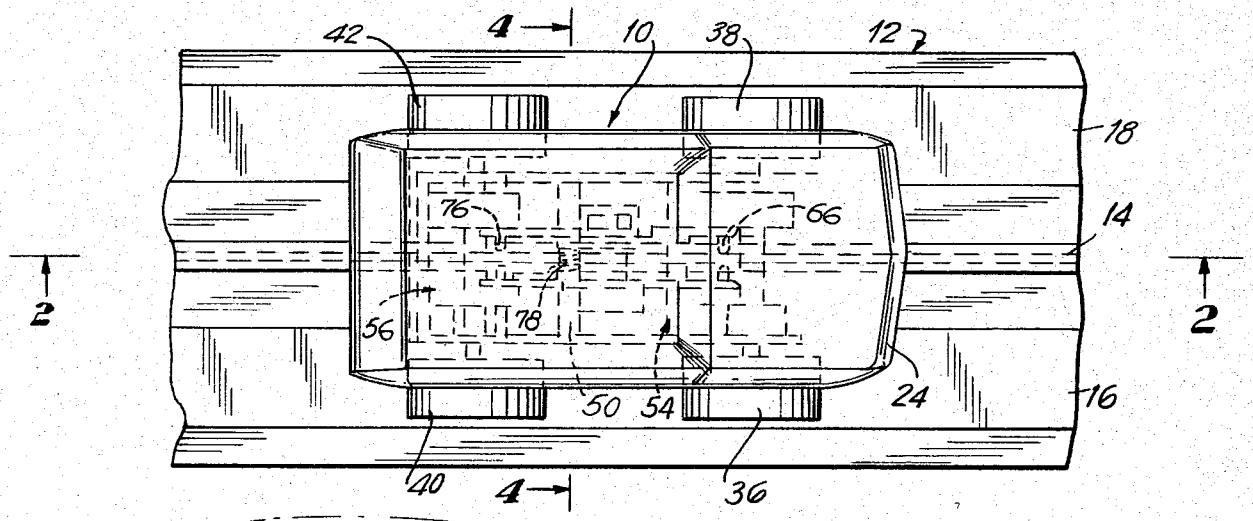
FIG. 1 is a fragmentary plan view of the toy vehicle and track assembly of the present invention with parts shown in phantom.
Figure 2:
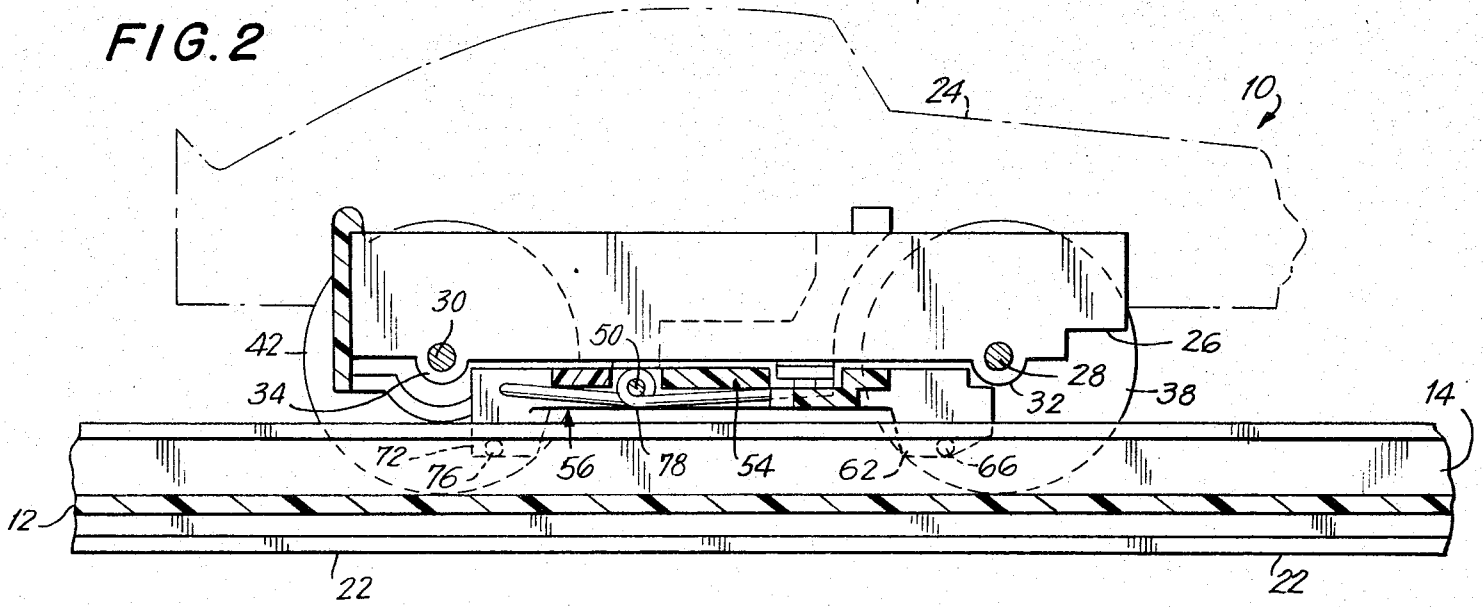
FIG. 2 is a sectional side view of the toy vehicle and track assembly taken along the lines 2—2 of FIG. 1, with parts shown in phantom.
Figure 3:
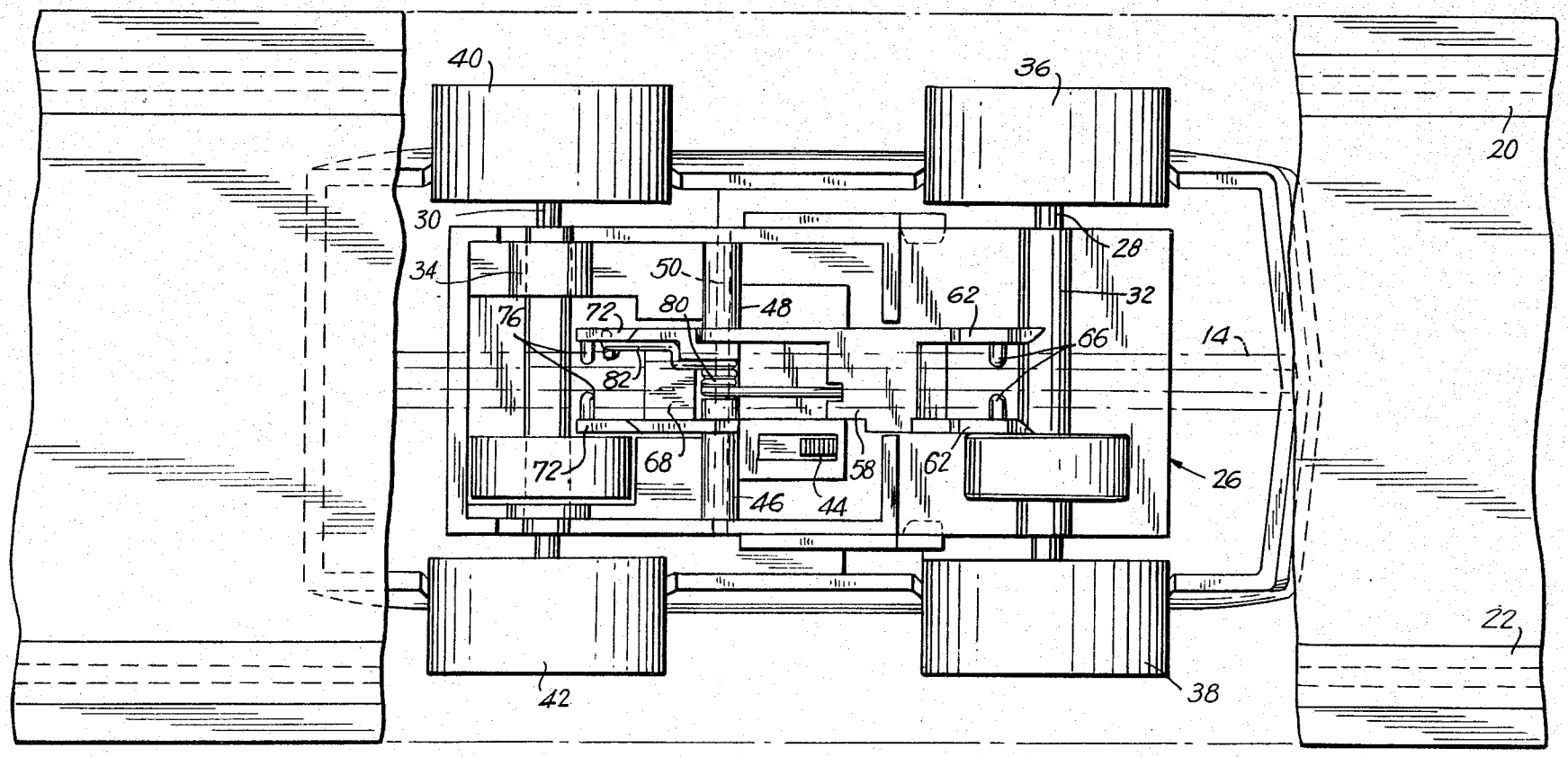
FIG. 3 is a bottom plan view of the toy vehicle and track assembly with parts broken away.
Figure 4:
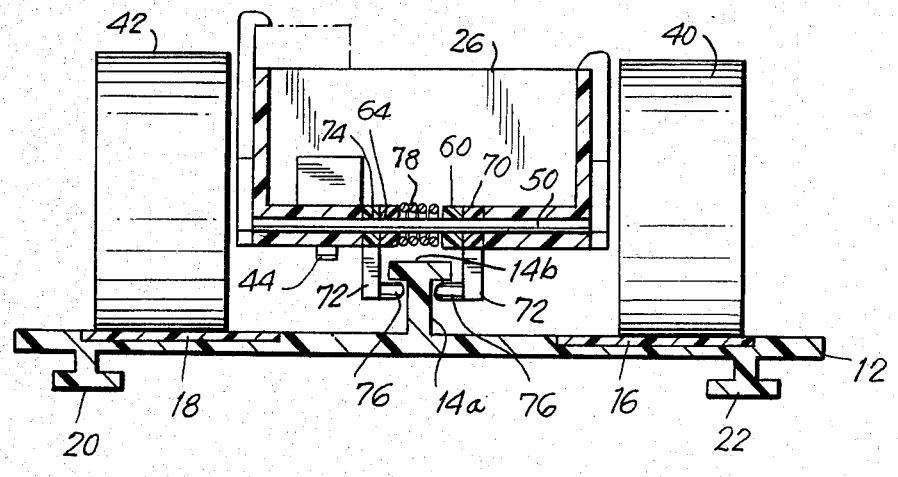
FIG. 4 is a sectional front elevation of the toy vehicle and track assembly taken along the lines 4—4 of FIG. 1.
Figure 5:
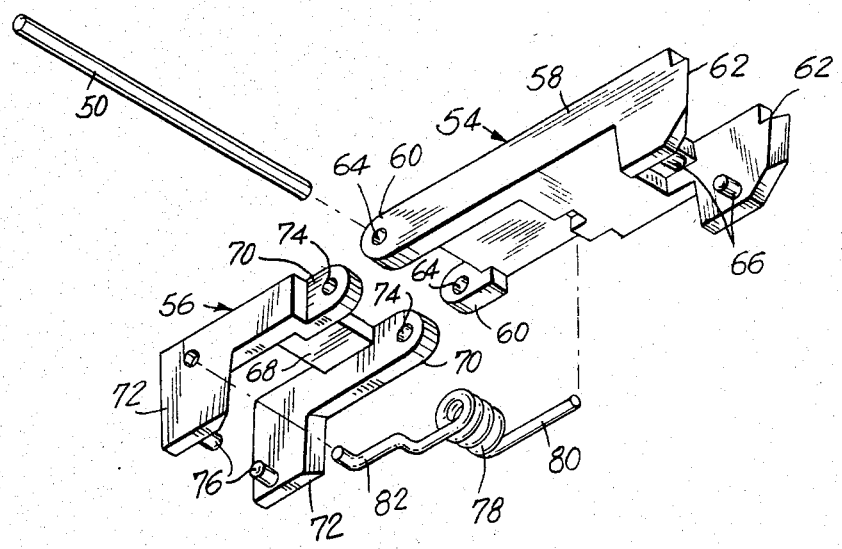
FIG. 5 is an exploded view of the mechanism connecting the toy vehicle to the track.
Figure 6:
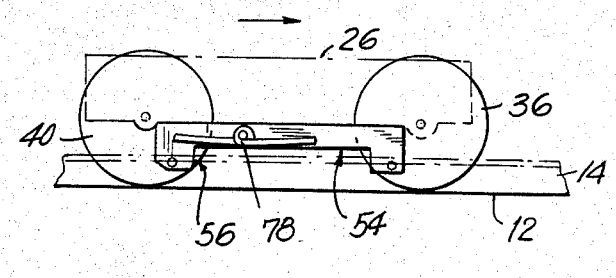
FIG. 6 is a fragmentary side elevation of the toy vehicle and track assembly in which the track is disposed in a generally horizontal plane and the vehicle is located above the track.
Figure 9:
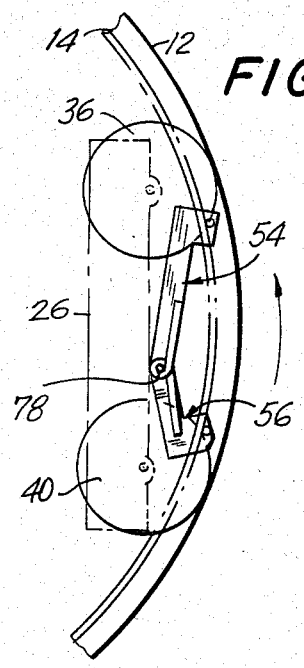
FIG. 9 is a fragmentary side elevation of the vehicle and track assembly in which the track is disposed in an arc with the vehicle located in the interior portion of the arc.
Figure 7:
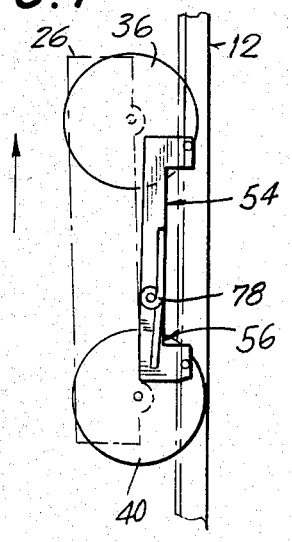
FIG. 7 is a fragmentary side elevation of the vehicle and track assembly in which the track is in a generally vertical plane.
Figure 10:
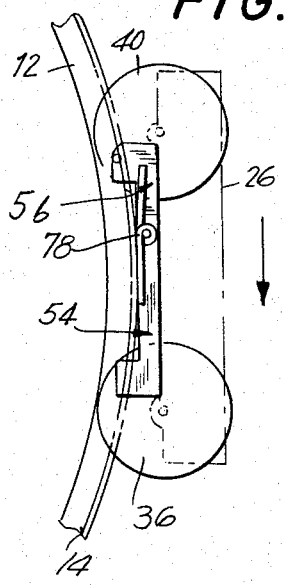
FIG. 10 is a fragmentary side elevation of the vehicle and track assembly in which the track is disposed in an arc and the vehicle is located in the exterior portion of the arc.
Figure 8:
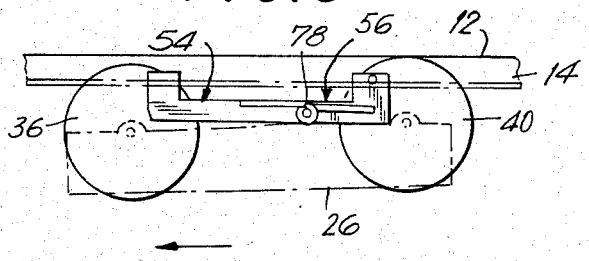
FIG. 8 is a fragmentary side elevation of the vehicle and track assembly in which the track is in a generally horizontal plane and the vehicle is located below the track.

Referring now to FIGS. 1–5, the toy vehicle and track assembly of the present invention includes a vehicle, indicated generally by the reference character 10, and a track 12. Track 12 may be formed from any suitable material, such as plastic, and may be endless or made up of sections which are assembled into any one of several configurations. Specifically, the track is formed with a T-shaped guide 14 which protrudes upwardly from the approximate center of the width of the track 12 and which extends along the entire length thereof. The T-shaped guide is formed from a low friction material and has a vertical portion 14*a*, corresponding to the base of the T, which extends from the track 12 and terminates in a horizontal portion 14*b* (FIG. 4). In addition, the track is formed with a pair of wheel paths 16 and 18 which extend along the length of the entire track 12 on opposite sides of the guide 14. Wheel paths 16 and 18 are formed from a material having a relatively high coefficient of friction such that wheel spin is prevented. Track 12 is also provided with feet 20 and 22 which protrude downwardly from the underside of the track 12 and extend along the length thereof. Feet 20 and 22 serve to space the track from any suitable platform and may be used to support the track in appropriate fixtures in banked curves, loops or the like.

Vehicle 10 includes a body 24 which may be of any suitable configuration and which is detachably affixed to a chassis 26. As various methods are known in the prior art for mounting the body 24 to the chassis and as this forms no part of the present invention, the particular method by which the body 24 is detachably affixed to the chassis 26 will not be described.

Chassis 26 rotatably supports a pair of axles 28 and 30 in respective sleeves 32 and 34 which extend across the width of the chassis 26 at the front and rear thereof. Front wheels 36 and 38 are secured to opposite ends of the axle 28 and rear wheels 40 and 42 are secured to opposite ends of axle 30.

Chassis 26 also supports a motor, not shown, which upon actuation is preferably adapted to rotate both the front and rear axles 28 and 30 thereby driving both the front wheels 36 and 38 and the rear wheels 40 and 42. An on/off switch 44, located along the underside of the chassis 26 controls the actuation of the motor. The motor and the associated transmission mechanisms are well known in the art and do not form any part of the present invention as as such will not be described in detail.

The underside of the chassis 26 (see FIG. 3) is formed with mounting bosses 46 and 48 which carry opposite ends of a pivot pin 50 at a point closer to the rear of the chassis 26 than the front. Pin 50 supports a first clip 54 and a second clip 56 (see FIG. 5) for limited pivotal movement about an axis extending along the pin 50 and perpendicular to the length of the vehicle 10. Clip 54 is formed from a body portion 58 from which extends feet 60 and downwardly extending arms 62. Feet 60 are compatible with the mounting bosses 46, 48 and are formed with holes 64 to receive pin 50. Arms 62 are formed with guide pins 66 which, as best seen in FIG. 4, are adapted to engage the guide 14 to connect the vehicle 10 to the track 12. Clip 56 is also formed with a body 68 from which extends feet 70 which are compatible with the mounting bosses 46, 48 and the feet 60 of the first clip 54. A pair of downwardly extending arms 72 also extend from the body 68. Feet 70 are formed with holes 74 to receive pin 50. Arms 72 are formed with guide pins 76 which are also adapted to engage the guide 14 to connect the vehicle 10 to the track 12.

As best seen in FIG. 4, when the vehicle 10 is moving along the track 12 guide pins 76 (and also guide pins 66) are located underneath the horizontal portion 14*b* of the guide 14 and on opposite sides of the vertical portion 14*a* of the guide 14. The vertical portion 14*a* comes in contact with a small surface area at the end of each of the guide pins 76 and serves to direct the vehicle along the track. As the vertical portion 14*a* is formed from a low friction material and as only a small surface area at the ends of the pins 76 come into contact with the vertical portion 14*a*, the vehicle 10 is guided along the track 12 with a minimal amount of resistance to the movement of the vehicle. The underside of the horizontal portion 14*b* of the guide 14 comes in contact with a small surface area on the top of each of the guide pins 76 to keep the vehicle 10 on the track 12 in situations where it is being urged off the track. As the horizontal portion 14*b* of the guide 14 is formed from low friction material and as only a small surface area on the top of the guide pins 76 come into contact with the horizontal portion 14*b*, the vehicle 10 is kept on the track 12 with a minimal amount of resistance to the movement of the vehicle.

Clip 54 extends towards the front of the chassis 26 and terminates at axle 28. Clip 56 extends toward the rear of the chassis 26 and terminates at axle 30. Clip 54 is longer in length than clip 56 and the length of clip 54 may be twice that of clip 56.

Pin 50 extends through a spring 78 which is disposed between feet 60 and 70 of the clips 54 and 56. Spring 78 is formed with ends 80 and 82 which engage respective clips 54 and 56. Spring 78 serves to bias clips 54 and 56 towards the chassis 26 to pull the vehicle 10 toward the track 12. The spring force exerted on clip 56 is greater than that exerted on clip 54, because clip 56 is shorter in length than clip 54. The force exerted on clip 56 may be twice that exerted on clip 54 if, for example, clip 54 is twice as long as clip 56. Clips 54 and 56 together with spring 78 serve to insure that at least one of the driving wheels 36, 38, 40 and 42 is always in driving contact with the track, as will be more fully described below.

In addition, since the clips 54 and 56 are pivotally mounted to the chassis 26 at a point which is closer to the rear of the chassis 26 than the front, if the vehicle 10 is urged off the track 12 the clips will cause the vehicle to pivot at a point closer to the rear of the vehicle than the front. As such, if the vehicle is urged off the track the front of the chassis 26 will move away from the track while moving the rear of the chassis 26 towards the track. This assures that the rear wheels 40 and 42 are maintained in contact with the track to maintain driving friction with the track.

The toy vehicle 10 may also be kept in contact with and guided along the track 12 by the use of only one clip, biased towards the chassis 26 by a suitable spring. Specifically, the vehicle and mechanism described above could be easily modified by, for example, the removal of clip 54, to yield a vehicle 10 having only one spring biased clip. This spring biased clip serves to guide the vehicle 10 along the track 12 and to pull the vehicle toward the track. In addition, this one spring biased clip will still cause the vehicle to pivot at a point closer to the rear of the chassis 26, so that if the vehicle 10 is urged off the track 12 the front of the chassis 26 will move away from the track and cause the rear of chassis 26 to move towards the track. This assures thet the rear wheels 40 and 42 are maintained in driving contact with the track.

Reference will now be made to FIGS. 6–11 for a description of the operation of the toy vehicle and track assembly of the present invention as vehicle 10 moves along track 12 driven by its four wheels 36, 38, 40 and 42. When the track 12 is disposed in a generally horizontal plane and vehicle 10 is located above the track (FIG. 6), all four wheels are normally in contact with the track and clips 54 and 56 serves to keep the vehicle 10 following the track 12.

When track 12 is disposed in a generally vertical plane (FIG. 7) and the vehicle is moving up the track the front wheels of the vehicle 10 may be pulled out of contact with the track 12 by the force of gravity, but the rear wheels are held in contact with the track to drive the vehicle thereon. This is accomplished even though the force of gravity tends to pull the vehicle off the track as the vehicle is held to the track by clips 54 and 56. The clips cause the vehicle to pivot at a point closer to the rear of the chassis 26 than the front (at pin 50) such that if the front of the chassis moves away from the track it moves the rear of the chassis towards and against the track. As such, the rear wheels 40 and 42 are maintained in contact with the track to maintain driving friction with the track. The pivoting action of the vehicle, which moves one end of the chassis towards the track, may be the result of the use of a first clip which is longer in length than the second clip. Alternatively, or in addition thereto, the clips may also be secured to the chassis at a point closer to the rear thereof. Further, the spring 78 serves to pull the vehicle towards the track by urging clips 52 and 54 towards the chassis 26, and by exerting a greater force through clip 54 to aid the pivoting action of the vehicle.

When the track is disposed in a generally horizontal plane and the vehicle 10 is moving below the track (FIG. 8) the front wheels 36 and 38 of the vehicle are pulled out of contact with the track but the rear wheels 40 and 42 are maintained in contact with the track to drive the vehicle thereon. This is accomplished, even though the force of gravity tends to pull the entire vehicle off the track, because the vehicle is held to the track by clips 54 and 56. Again, the clips cause the vehicle to pivot at a point closer to the rear of the chassis (at pin 50) such that the front of the chassis moves away from the track while moving the rear of the chassis towards the track. As such, the rear wheels 40 and 42 are maintained in contact with the track and serve to drive the vehicle thereon. In addition, the spring 78 serves to pull the vehicle towards the track by urging clips 52 and 54 towards the chassis 26, and by exerting a greater force through clip 54, to aid the pivoting action of the vehicle.

When the track follows an arc-shaped path with the vehicle moving along the interior portion of the arc (FIG. 9) both the front and rear wheels are maintained in contact with the track 12. Again, the vehicle is moved away from the track by the natural curve of the track and the force of gravity, but it is kept in driving contact with the track by the action of clips 54 and 56. Any movement of the front of the vehicle away from the track causes the rear of the vehicle to move towards the track thereby assuring that the rear wheels 40 and 42 are maintained in driving contact with the track. In addition, the spring 78 serves to pull the vehicle towards the track by urging clips 52 and 54 towards the chassis 26 and by exerting a greater force on clip 54.

When the track follows an arc-shaped path with the vehicle moving along the exterior portion of the arc (FIG. 10) both the front and rear wheels are maintained in contact with the track. Again, the vehicle is moved away from the track by the force of gravity, but is kept in driving contact with the track by the action of clips 54 and 56. Any movement of the front of the vehicle away from the track serves to move the rear of the vehicle against the track assuring that the rear wheels 40 and 42 are maintained in driving contact with the track. In addition, the spring 78 serves to pull the vehicle towards the track by urging clips 52 and 54 towards the chassis 26.

Figure 11:
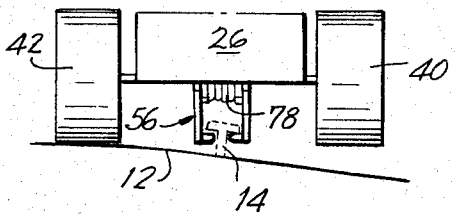
FIG. 11 is a front view of the vehicle and track assembly in which the track is twisted.

When the track is twisted into a screw like shape, two of the four wheels will no longer be in driving contact with the track. In this situation, the action of the clips 52 and 54 and the spring 78 serve to maintain the other two wheels in driving contact with the track as seen in FIG. 11.

As will be readily apparent to those skilled in the art, the invention may be used in other specific forms or for other purposes without departing from its spirit or central characteristics. The present embodiment is therefore to be considered as illustrative and not restrictive, the scope of the invention being indicated by the claims rather than by the foregoing description, and all embodiments which come within the range of equivalence of the claims are intended to be embraced.

We claim:

1. Apparatus including in combination a vehicle formed with a plurality of wheels and a motor adapted to drive said wheels upon actuation, a track along which said vehicle travels, said track formed with a guide extending the length of said track, a first clip mounted for pivotal movement to the underside of said vehicle, said first clip adapted to engage said guide, a second clip mounted for pivotal movement to the underside of said vehicle, said second clip adapted to engage said guide, said first and second clips cooperating to guide said vehicle along said track and positioned on said vehicle so as to maintain said vehicle moving on said track by pivoting said vehicle with respect to said track such that one end of said vehicle is urged towards said track and at least one of said wheels is always in driving contact with the track.

2. Apparatus as in claim 1 in which said second clip is shorter in length than said first clip and said clips are mounted to the underside of said vehicle at a common location.

3. Apparatus as in claim 2 in which said common location is closer to the rear end of the vehicle than the front end.

4. Apparatus as in claim 3 in which said clips are biased so as to pull the vehicle toward the track.

5. Apparatus as in claim 4 in which the biasing force on said second clip is greater than the biasing force on said first clip.

6. Apparatus as in claim 5 in which said biasing force is provided by a spring.

7. Apparatus including in combination a vehicle formed with a plurality of wheels and a motor adapted to drive said wheels upon actuation, a track along which said vehicle travels, said track formed with a guide extending the length of said track, at least one clip mounted for pivotal movement to the underside of said vehicle and extending towards one end of said vehicle, said clip adapted to engage said guide, means biasing said clip so as to pull said clip toward the vehicle, said clip and said biasing means cooperating to guide said vehicle along said track and positioned on said vehicle so as to maintain said vehicle moving on said track by pivoting said vehicle with respect to said track such that one end of said vehicle is urged towards said track and at least one of said wheels is always in driving contact with the track.

8. Apparatus as in claim 7 in which said guide is formed from a horizontal portion and a vertical portion, said vertical portion extending from said track and terminating in said horizontal portion to form a guide with a T-shaped cross section.

9. Apparatus as in claim 8 in which said clip engages the opposite sides of said vertical portion to guide said vehicle along said track and the underside of said horizontal portion to keep said vehicle on said track.

10. Apparatus as in claim 9 in which said clip is mounted to the underside of said vehicle at a point which is closer to the rear end of said vehicle than the front end and the clip extends toward the rear of said vehicle.

11. Apparatus including in combination a vehicle formed with a pair of front wheels and a pair of rear wheels and a motor adapted to drive said wheels upon actuation, a track along which said vehicle travels, said track formed with a guide extending the length of said track, a first clip mounted for pivotal movement to the underside of said vehicle, said first clip extending towards said front wheels and adapted to engage said guide, a second clip mounted for pivotal movement to the underside of said vehicle, said second clip extending towards said rear wheels and adapted to engage said guide, said clips mounted to the underside of said vehicle at a common location located closer to the rear end of the vehicle than the front, and said first clip being longer in length than said second clip, means biasing said first and second clips so as to pull said clips to said vehicle, said biasing means and said clips cooperating to move said vehicle towards said track such that at least one of said wheels is always in driving contact with said track.

12. Apparatus as in claim 11 in which the biasing force on said second clip is greater than the biasing force on said first clip.

13. Apparatus as in claim 11 in which said track is formed with a pair of wheel paths which extend along the length of the track on opposite sides of said guide, said wheel paths formed so as to have a relatively high coefficient of friction so as to prevent wheel spin and said guide formed so as to have a relatively low coefficient of friction.

14. Apparatus including in combination a vehicle formed with a front and back, a plurality of wheels and a motor adapted to drive said wheels upon actuation, a track along which said vehicle travels, said track formed with a guide extending the length of said track, a first clip mounted for pivotal movement to the underside of said vehicle and extending towards the front of said vehicle, said first clip adapted to engage said guide at a location proximate to said front of said vehicle, a second clip mounted for pivotal movement to the underside of said vehicle and extending towards the rear side of said vehicle, said second clip adapted to engage said guide at a location proximate said rear of said vehicle, said first and second clips cooperating to guide said vehicle along said track and positioned on said vehicle so as to maintain said vehicle moving on said track by pivoting said vehicle with respect to said track such that one end of said vehicle is urged towards said track and at least one of said wheels is always in driving contact with the track.

15. Apparatus as in claim 14 in which said second clip is shorter in length than said first clip and said clips are mounted to the underside of said vehicle at a common location.

16. Apparatus as in claim 15 in which said common location is closer to the rear end of the vehicle than the front end.

17. Apparatus as in claim 16 in which said clips are biased so as to pull the vehicle toward the track.

18. Apparatus as in claim 17 in which the biasing force on said second clip is greater than the biasing force on said first clip.

19. Apparatus as in claim 18 in which said biasing force is provided by a spring.

* * * * *